US006382059B1

(12) United States Patent
Francis

(10) Patent No.: US 6,382,059 B1
(45) **Date of Patent: *May 7, 2002**

(54) TORQUE WRENCH SYSTEM

(76) Inventor: Dale Francis, 379 Fairfield Ave., Gretna, LA (US) 70056

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 429 days.

(21) Appl. No.: 08/965,818

(22) Filed: Nov. 7, 1997

Related U.S. Application Data

(63) Continuation of application No. 08/734,305, filed on Oct. 21, 1996, now abandoned, which is a continuation of application No. 08/600,469, filed on Feb. 12, 1996, now abandoned, which is a continuation of application No. 08/261,430, filed on Jun. 17, 1994, now abandoned.

(51) Int. Cl.[7] ..... B25B 23/14

(52) U.S. Cl. ..... 81/467; 81/470; 81/57.39; 81/58.1

(58) Field of Search ..... 81/467, 469, 470, 81/57.39, 58.1; 173/176, 177, 179, 181

(56) References Cited

U.S. PATENT DOCUMENTS

| | | | | | |
|---|---|---|---|---|---|
| 2,702,489 | A | * | 2/1955 | Wallace, Sr. | 81/58.1 |
| 2,720,803 | A | | 10/1955 | Rice et al. | 81/470 |
| 2,867,144 | A | * | 1/1959 | Stevens | 81/470 |
| 3,686,983 | A | | 8/1972 | Flagge | 81/470 |
| 3,733,935 | A | * | 5/1973 | Tsuji | 81/58.1 X |
| 3,739,659 | A | | 6/1973 | Workman, Jr. | 74/751 |
| 3,845,673 | A | | 11/1974 | Karden et al. | 81/470 |
| 3,939,924 | A | * | 2/1976 | Grabovac | 81/58.1 X |
| 3,965,778 | A | | 6/1976 | Aspers et al. | 81/52.4 |
| 4,300,641 | A | * | 11/1981 | Kinkel | 173/177 |
| 4,325,274 | A | * | 4/1982 | Martelee | 81/58.1 X |
| 4,513,827 | A | | 4/1985 | Dubiel | 81/467 |
| 4,522,269 | A | | 6/1985 | Adman et al. | 81/470 |
| 4,679,469 | A | * | 7/1987 | Coyle, Sr. | 81/470 |
| 4,898,248 | A | * | 2/1990 | Thompson | 81/470 X |
| 5,005,654 | A | * | 4/1991 | Moriki et al. | 81/470 X |
| 5,097,730 | A | * | 3/1992 | Bernard et al. | 81/57.39 |
| 5,186,262 | A | * | 2/1993 | Thompson | 81/470 X |

* cited by examiner

*Primary Examiner*—D. S. Meislin
(74) *Attorney, Agent, or Firm*—Garvey, Smith, Nehrbass & Doody, L.L.C.; Gregory C. Smith; Brett A. North

(57) ABSTRACT

An improved system for installing and removing bolts or nuts from flanged joints or the like which includes a primary wrench for engaging the head of the bolt and rotating the bolt during the high-torque phase of removal or installation; a low-torque motor engaged with the wrench for rotating the bolt during the low-torque phase of removal or installation; a source of hydraulic fluid for driving the low-torque motor during the low-torque phase, and driving the high-torque wrench during the high-torque phase; and valving means for instantly sensing the high-torque and low-torque phases, in order to drive the hydraulic wrench or the motor depending on the torque required.

3 Claims, 4 Drawing Sheets

TORQUE WRENCH SYSTEM

This application is a continuation of U.S. Ser. No. 08/734,305, filed Oct. 21, 1996, now abandoned, which was a continuation of U.S. Ser. No. 08/600,469, filed Feb. 12, 1996, now abandoned which was a continuation of U.S. Ser. No. 08/261,430, filed Jun. 17, 1994, now abandoned.

BACKGROUND OF THE INVENTION

1. Field Of The Invention

The present invention relates to torquing systems. More particularly, the present invention relates to an improved torque wrench system which provides for the makeup and removal of threaded bolts with a single tool during both high torque and low torque phases of the makeup or removal process.

2. General Background

In the makeup or break down of large structures, such as, for example rig risers, the sections of the riser are flanged together with bolts threadedly engaged to flanges on the end of each section, and made up very tightly to complete the structure. Of course, there are numerous other types of structures which utilize this same system of makeup, utilizing very large bolts to flange together sections of the structure.

When this type of makeup system is utilized, there is usually required at least two tools in the makeup. First, a high speed, low torque motor or wrench is utilized to begin the threading of the bolt into the flange. However, as the bolt is tightened, it requires a very high amount of torque, in the neighborhood of 40 thousand ft. lbs. in order to complete the makeup. Therefore, a second tool, such as a hydraulic ratchet, is utilized, which imparts a very high torque to the bolt, and completes the makeup procedure. Of course, when the bolts must be removed, the high torque wrench would be utilized to commence the removal of the bolt, and then, to increase the speed of removal, a high speed low torque motor or the like would be engaged. This two step process is very time-consuming, and inefficient. However, up to now, this was the state of the art in the makeup and removal of such bolts from structures.

There were several patents found in the art which address the subject matter of torque applied to bolts, or the like, and these are referred to in the Prior Art statement submitted concurrently herewith.

SUMMARY OF THE PRESENT INVENTION:

The system of the present invention solves the shortcomings in the art in a simple and straightforward manner. What is provided is an improved system for installing and removing bolts from flanged joints or the like which includes a primary wrench for engaging the head of the bolt and rotating the bolt during the high-torque phase, a low-torque motor engaged with the wrench for rotating the bolt during the low-torque phase of removal or installation; a source of fluid for driving the low-torque motor during the low-torque phase, and driving the high-torque wrench during the high-torque phase; and valving means for sensing the high-torque and low-torque phases, in order to drive the hydraulic wrench or the motor depending on the torque required.

Therefore, it is a principal object of the present invention to provide a combination high-torque, low-torque system for installing or removing bolts or the like from structures;

It is a further object of the present invention to provide a system for removing bolts from flanged structures with a single combination tool which works under both low-torque or high-torque conditions, depending on the condition sensed by the system;

It is a further object of the present invention to provide a system for removing or installing bolts having a very low clearance and normally inaccessible to wrenches having both high speed low torque and low speed high torque capacities.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 1:
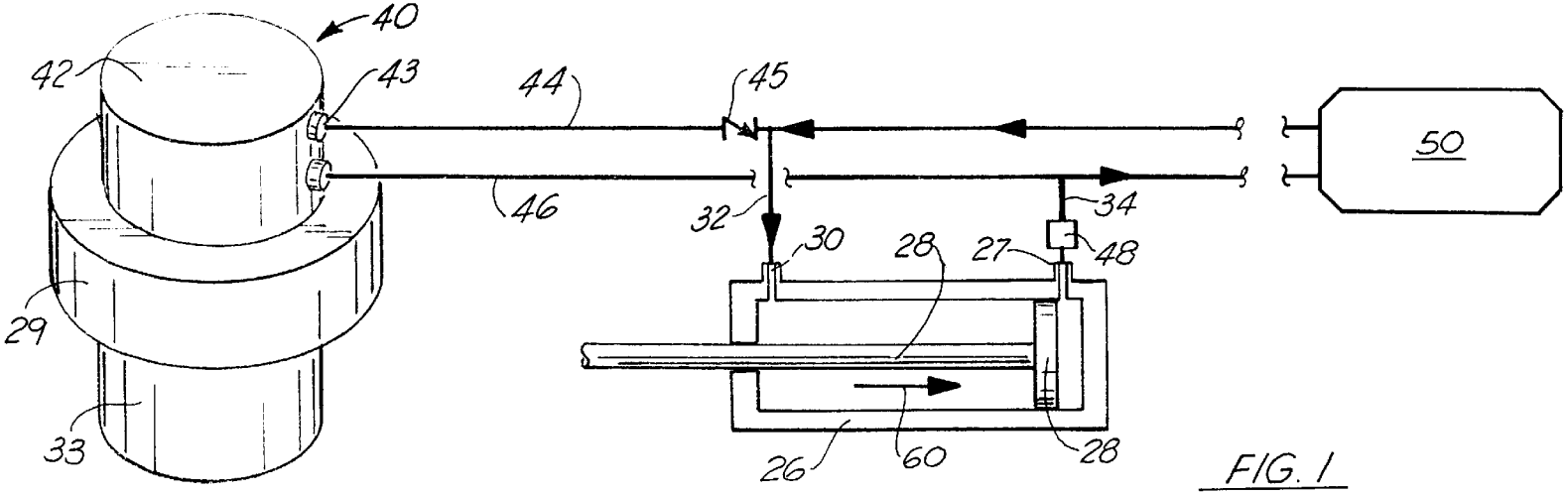
FIG. 1 illustrates a schematic of the improved system of the present invention in a resting state.
Figure 2:
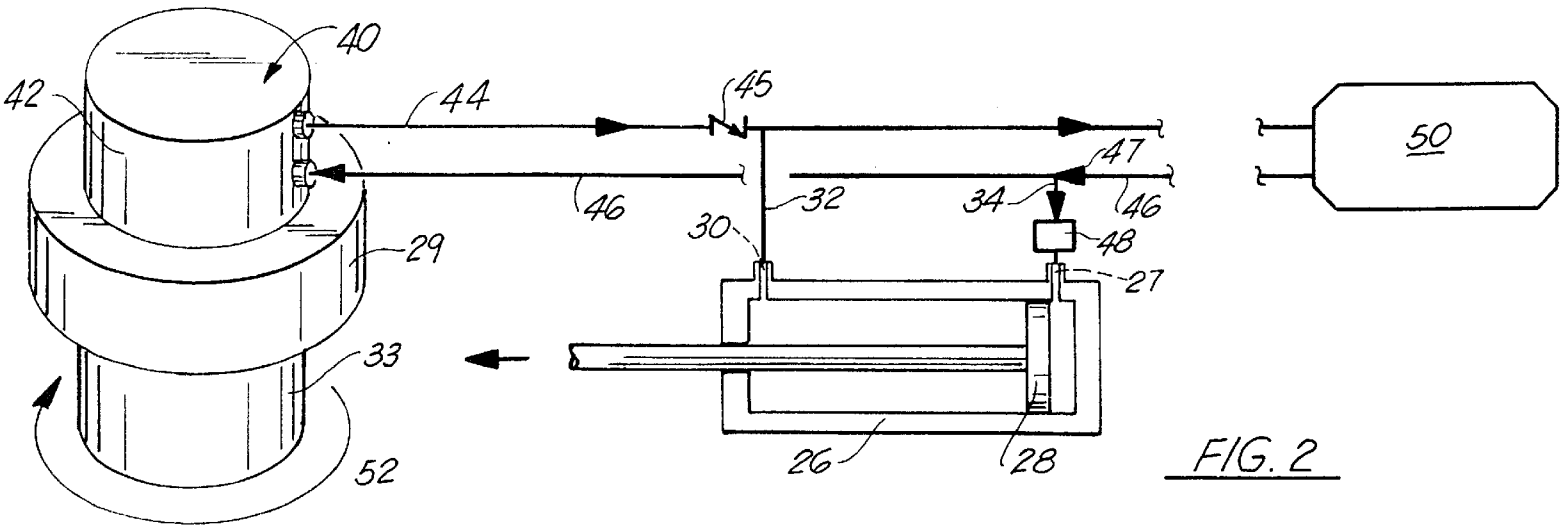
FIG. 2 illustrates a schematic of the improved system of the present invention in the low-torque operational phase of the system.
Figure 3:
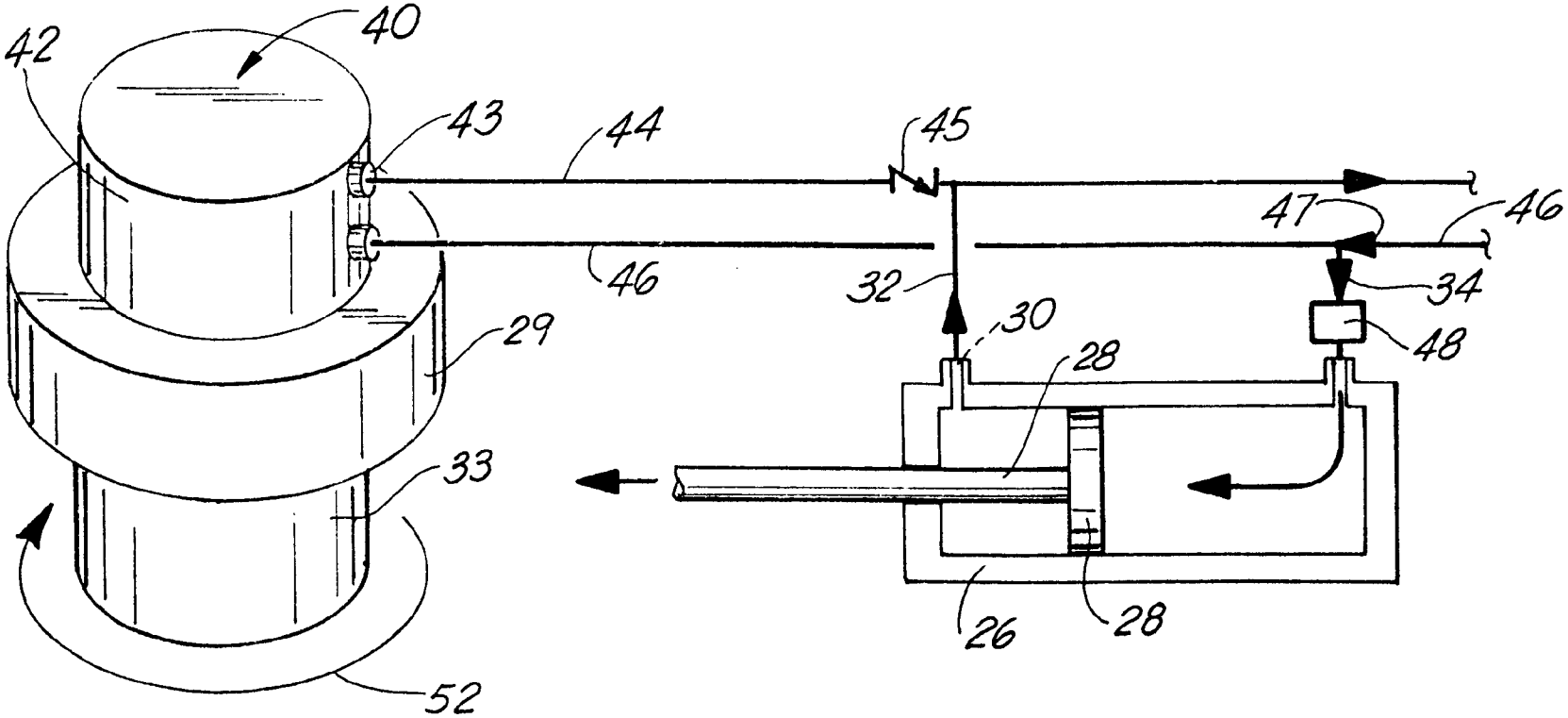
FIG. 3 illustrates a schematic of the improved system of the present invention in the high-torque operational phase of the system.
Figure 4:
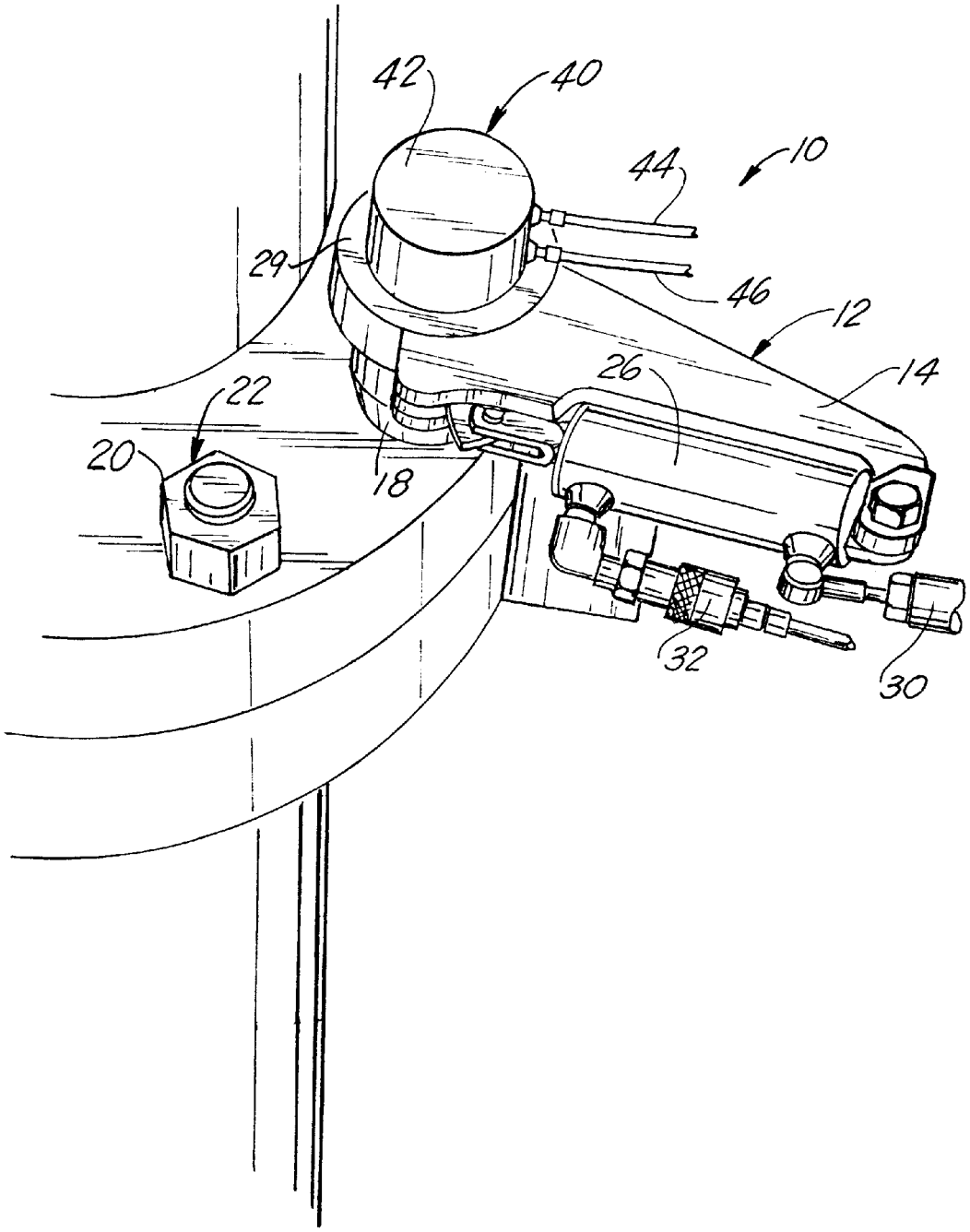
FIG. 4 illustrates a high-torque hydraulic wrench secured to a bolt head during use in the system of the present invention.

FIGS. 1 through 5 illustrate the preferred embodiment of the present invention, with FIGS. 1 through 3 illustrating the system in schematic view by the numeral 10. Before turning to the schematic views of the system, reference is made to FIG. 4 which illustrates the system engaged to a bolt head in installation or removal of the bolt. As illustrated system 10 comprises in combination a primary hydraulic wrench 12, which is a hydraulic wrench adapted to tighten or loosen bolts or nuts in very high-torque situations (40,000 ft. lb range), and is of the type generally disclosed in U.S. Pat. No. 5,097,730, issued to Bernard et al, and incorporated herein by reference thereto. Generally, the wrench 12 would include a wrench body 14, secured to a socket 18, adapted thereto for engaging the head 20 of a bolt 22 threadably secured to a flange 24 as seen in FIG. 4. For purposes of discussion, the system 10 may be adapted to the head of bolt 22, or to a nut 22, depending on the circumstances. Therefore, for purposes of discussion on the terms nut or bolt shall be used interchangeably, and would include any threaded member.

Wrench 12 would further include a hydraulic cylinder 26, having a hydraulically driven piston 28 (See FIG. 1), moved inward and outward from cylinder 26. The distal end of piston 28 includes a means for rotating a drive ratchet head 29, engaged to the head 20 of bolt 22 to rotate the bolt 22. The hydraulic fluid into cylinder 26 is provided through lines 30, 32, which depending on the flow would impart the inward and outward movement of the piston 28 during operation. This construction is known in the art and generally disclosed in U.S. Pat. No. 5,097,730, previously referenced.

Turning now to the novel combination of the invention, FIG. 4 illustrates in combination with wrench 12, a hydraulically driven motor 40, of the type which would be a low-torque motor (500 ft. lbs. or below), which would have the ability to rotate bolts or nuts which have been loosened and must simply be rotated out of their threaded ports. As illustrated in FIG. 4, motor 40 would include an upper body 42, having a pair of hydraulic lines 44, 46 thereinto for imparting rotation to a shaft (not illustrated) which would engage the upper face of the wrench drive ratchet head 29 in order to rotate the drive ratchet head 29 under low-torque, high speed conditions, in order to complete the removal of the bolt after the bolt is loosened by the high-torque wrench, or to impart initial high rotation of the bolt 22 when it is first placed into a typical threaded port. The manner in which this combination operates in order to undertake these two tasks is explained in reference to FIGS. 1 through 3.

Turning now to those figures, there is illustrated, in schematic form, the system in the resting state in FIG. 1. As illustrated, motor 40 is engaged to the drive ratchet head 29 via shaft 31 (seen in FIG. 5), which is in turn engaged to a drive socket 33 which engages both the wrench 12 and the head 20 bolt 22 to be tightened. Motor 40 includes the pair of hydraulic lines 44, 46 referred to earlier, which supply the flow of hydraulic fluid into and out of motor head 42. Further, there is illustrated hydraulic cylinder 26 of wrench 12 which likewise is supplied with hydraulic fluid from lines 32, 34 which feed off of lines 44, 46 respectively. As seen, lines 32, 34 feed into hydraulic cylinder chamber 26, for imparting forward or rearward movement to piston member 28 within hydraulic cylinder 26 as required. Further, there is included a check valve 45 in line 44 which prevents fluid from flowing into port 43 in motor head 42, but allows flow of fluid out from port 43. Also, there is a reverse flow regulating valve 48 in line 34 which will allow fluid to flow into a first port 27 in cylinder 26 only upon reaching previously set fluid pressure. The flow line 33, which comprises flow line 32 and flow line 34, includes a first flow path 44 for transmitting fluid under low torque conditions from a fluid source 50 to the low torque fluid driven rotary motor 40 and from the low torque motor 40 back to the fluid source 50. There is further included a second flow path 46 for transmitting fluid under the high torque condition from the fluid source 50 to the high torque wrench means 12 and from the high torque wrench means 12 back to the fluid source. There is also included a flow line, for transmitting fluids to and from the fluid source 50, the flow line forming a part of both the first flow path 44 and the second flow path 46. There is also a valve means which is defined by check valve 45 in flow line 34 as seen in FIGS. 1 and 2.

In FIG. 1 the hydraulic fluid from a source 50, is flowing through line 44, and is halted at check valve 45, and routed into line 32 which feeds into a second port 30 in cylinder 26, and has pushed the piston 28 within cylinder 26 rearward. In this position, neither the motor 40 or the wrench 12 is operating to rotate a bolt or nut 22, but is in what is called the "resting state".

In FIG. 2, the socket 33 has engaged a nut 22, which needs to be tightened in the direction of arrow 52. Hydraulic fluid is then allowed to flow through line 46, from source 50, in the direction of arrows 47, under low pressure initially. The valve 48 will not allow the fluid to enter first port 27, beneath the required minimum pressure, so the fluid flows through line 46 into motor 40, where the fluid flow begins to rotate the shaft 31 of motor 40 at high speed, imparting high-speed rotation to bolt 22, under very low torque. The hydraulic fluid flowing through motor 40 will flow from motor 40 through line 44, by one-way check valve 45, and return to fluid source 50. This fluid flow will continue as long as the torque required is below 500 ft. lbs. of torque, and the low-torque motor 40 is able to rotate the nut or bolt 22.

When the bolt has been tightened to a degree that the low-torque, high-speed motor 40 cannot rotate it, reference is made to FIG. 3. In that figure, the motor 40 is unable to be driven further, the fluid pressure builds up in lines 46 and 34, and valve 48 opens under the required pressure, allowing fluid into first port, 27 of cylinder 26. Piston 28 in cylinder 26 is driven forward by the fluid pressure, and the distal end of piston 28 engages the ratchet head 29 to impart high-torque rotation to bolt head. Once the arm moves fully forward, the fluid flow is manually switched to line 44 where it engages check valve 45, flows through line 32 into second port 30 in cylinder 26, and moves the piston rearward, in the direction of arrow 60. The fluid to the rear of piston 28 is forced out of first port 27, and returns to the source 50 via line 46. This process is repeated, until the bolt has been completely tightened to the required high torque, and then the system may then be applied to another bolt or nut 22.

Figure 5:
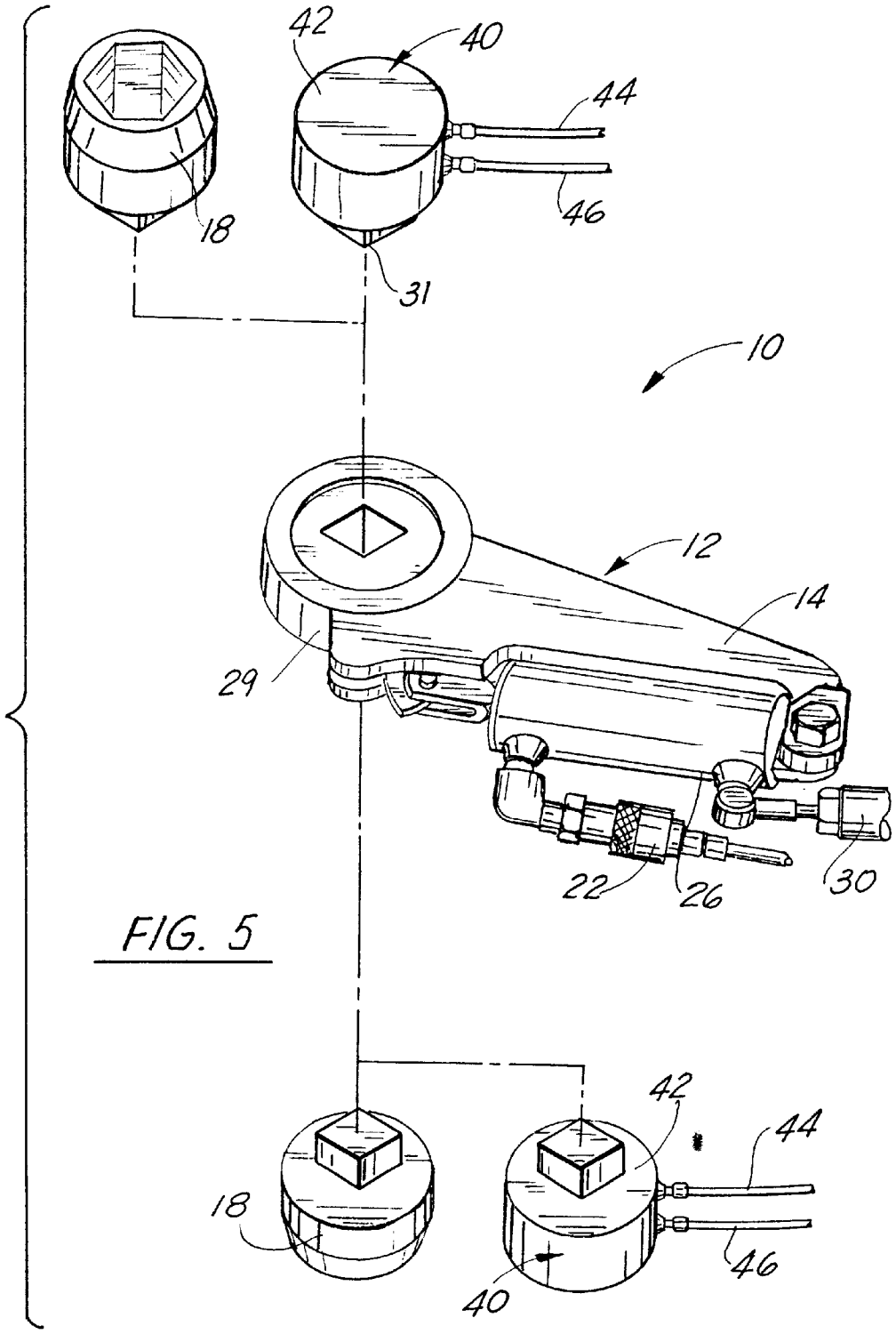
FIG. 5 illustrates an exploded view of the hydraulic wrench adaptable to tighten or loosen bolts during operation in the system of the present invention.

Should one wish to loosen the nut or bolt 22 in the process, reference is made to FIG. 5. In that FIGURE, there is illustrated wrench 12 which would simply be inverted 180 degrees, and the hydraulic lines 44, 46 to the motor 20 would be switched, so that the rotation of the hydraulic motor 40 would be opposite from the original rotation format. In this format, the process as described in FIGS. 2 and 3 would be undertaken, to impart the high-torque wrench 12 to the bolt or nut head 22 in order to initially loosen it. Following the loosening of the bolt 22 to a low-torque status, the hydraulic pressure would therefore drop, the motor 20 would begin to rotate and loosen the bolt 22, and the fluid would not enter cylinder 26, held in check by valve 48.

The following table lists the part numbers and part descriptions as used herein and in the drawings attached hereto.

PARTS LIST

| Description | Part Number |
|---|---|
| system | 10 |
| hydraulic wrench | 12 |
| wrench body | 14 |
| socket | 18 |
| head | 20 |
| bolt | 22 |
| flange | 24 |
| hydraulic cylinder | 26 |
| first port | 27 |
| piston | 28 |
| drive ratchet head | 29 |
| second port | 30 |
| shaft | 31 |
| fluid lines | 32, 34 |
| drive socket | 33 |
| hydraulic motor | 40 |
| motor head | 42 |
| port | 43 |
| hydraulic lines | 44, 46 |
| check valve | 45 |
| reverse flow regulating valve | 48 |
| fluid source | 50 |
| arrow | 52 |
| arrow | 60 |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. An improved system for installing and removing bolts and nuts from flanged joints in both a high torque phase and a low torque phase which comprises:

a) a wrench body having first and second end portions with a rotatable drive head on the first end of the body for engaging and rotating the bolt or nut;

b) a high-torque motor that includes a hydraulic cylinder attached to the wrench body for receiving fluid under pressure for rotating the drive head during the high-torque phase, the cylinder having an extendable push-rod operatively connected to the drive head enabling said rotation;

c) a low-torque motor which is also operatively connected to the drive head and rotates the bolt or the nut during the low-torque phase of removal or installation;

d) a source of pressurized hydraulic fluid;

e) a plurality of flow lines for transmitting fluid between the fluid source and the high and low-torque motors, including a first pair of flowlines that communicate with the low-torque motor and a second pair of flow-lines that communicate with the high-torque motor;

f) a valving member that, upon reaching a pre-selected high-torque value, opens responsive to increasing fluid pressure to divert fluid flow to the high-torque motor for driving the high-torque motor during the high-torque phase;

g) wherein the valving member senses fluid pressure and diverts flow to thereby define the high-torque and low-torque phases; and h) the valve member automatically opening or closing responsive to a change in fluid pressure to selectively drive the high-torque motor or the low-torque motor depending on the torque value required, wherein the valving member diverts fluid flow without the use of strain gauges, solenoid valves, or electronic pressure switches.

2. An improved system for installing and removing bolts and nuts from flanged joints in both a high torque phase and a low torque phase which comprises:

a) a wrench body having first and second end portions with a rotatable drive head on the first end of the body for engaging and rotating the bolt or nut;

b) a high-torque motor that includes a hydraulic cylinder attached to the wrench body for receiving fluid under pressure for rotating the drive head during the high-torque phase, the cylinder having an extendable push-rod operatively connected to the drive head enabling said rotation;

c) a low-torque motor which is also operatively connected to the drive head and rotates the bolt or the nut during the low-torque phase of removal or installation;

d) a source of pressurized hydraulic fluid;

e) a plurality of flowlines for transmitting fluid between the fluid source and the high and low-torque motors, including a first pair of flowlines that communicate with the low-torque motor and a second pair of flow-lines that communicate with the high-torque motor;

f) a valving member that, upon reaching a pre-selected high-torque value, opens responsive to increasing fluid pressure to divert fluid flow to the high-torque motor for driving the high-torque motor during the high-torque phase;

g) wherein the valving member senses fluid pressure and diverts flow to thereby define the high-torque and low-torque phases; and h) the valve member automatically opening or closing responsive to a change in fluid pressure to selectively drive the high-torque motor or the low-torque motor depending on the torque value required, wherein the valving member diverts fluid flow without the use of electricity.

3. An improved system for installing and removing bolts and nuts from flanged joints in both a high torque phase and a low torque phase which comprises:

a) a wrench body having first and second end portions with a rotatable drive head on the first end of the body for engaging and rotating the bolt or nut;

b) a high-torque motor that includes a hydraulic cylinder attached to the wrench body for receiving fluid under pressure for rotating the drive head during the high-torque phase, the cylinder having an extendable push-rod operatively connected to the drive bead enabling said rotation;

c) a low-torque motor which is also operatively connected to the drive bead and rotates the bolt or the nut during the low-torque phase of removal or installation;

d) a source of pressurized hydraulic fluid;

e) a plurality of flowlines for transmitting fluid between the fluid source and the high and low-torque motors, including a first pair of flowlines that communicate with the low-torque motor and a second pair of flow-lines that communicate with the high-torque motor;

f) a valving member that, upon reaching a pre-selected high-torque value, opens responsive to increasing fluid pressure to divert fluid flow to the high-torque motor for driving the high-torque motor during the high-torque phase;

g) wherein the valving member senses fluid pressure and diverts flow to thereby define the high-torque and low-torque phases; and h) the valve member automatically opening or closing responsive to a change in fluid pressure to selectively drive the high-torque motor or the low-torque motor depending on the torque value required, wherein the low-torque motor directly engages, without intermediate gears, the drive head.

* * * * *